US009290308B2

(12) United States Patent
Bashyam et al.

(10) Patent No.: US 9,290,308 B2
(45) Date of Patent: Mar. 22, 2016

(54) DISPENSING CLOSURE ASSEMBLY WITH PRE-VENTING

(71) Applicant: Closure Systems International Inc., Indianapolis, IN (US)

(72) Inventors: Navaneeth Bashyam, West Lafayette, IN (US); Santiago Julian Pidevall, Barcelona (ES); Javier Exposito Rosales, Terrassa (ES)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 14/596,442

(22) Filed: Jan. 14, 2015

(65) Prior Publication Data

US 2015/0197380 A1 Jul. 16, 2015

Related U.S. Application Data

(60) Provisional application No. 61/927,238, filed on Jan. 14, 2014.

(51) Int. Cl.
*B67D 1/00* (2006.01)
*B65D 47/24* (2006.01)

(52) U.S. Cl.
CPC ..... *B65D 47/243* (2013.01)

(58) Field of Classification Search
CPC ..... B65D 47/243; B65D 51/2807; B65D 47/242; B65D 47/0814; B65D 47/0857
See application file for complete search history.

(56) References Cited

U.S. PATENT DOCUMENTS

| | | | | |
|---|---|---|---|---|
| 1,861,442 | A * | 6/1932 | Hammerstein | B65D 47/243 222/514 |
| 3,834,596 | A * | 9/1974 | Brady | B65D 47/242 222/520 |
| 5,609,276 | A * | 3/1997 | Greatbatch | B65D 47/242 222/520 |
| 5,975,369 | A | 11/1999 | Yurkewicz et al. | |
| 6,321,924 | B1 | 11/2001 | Yurkewicz et al. | |
| 6,758,359 | B2 | 7/2004 | Yurkewicz et al. | |

(Continued)

FOREIGN PATENT DOCUMENTS

| | | | |
|---|---|---|---|
| CN | 203094727 | U | 7/2013 |
| WO | 2006053845 | A1 | 5/2006 |

(Continued)

OTHER PUBLICATIONS

International Search Report for corresponding application No. PCT/US2015/011302.

*Primary Examiner* — Frederick C Nicolas
*Assistant Examiner* — Bob Zadeh
(74) *Attorney, Agent, or Firm* — Wood, Phillips, Katz, Clark & Mortimer

(57) ABSTRACT

A dispensing closure assembly is particularly configured for use on a container having carbonated or otherwise pressurized contents. The closure assembly includes a closure shell having an annular mounting collar, and an axially moveable tip positioned on the mounting collar for axial movement between opened and closed positions. Notably, the closure assembly includes an arrangement of venting projections, preferably provided on the closure shell, which provide preventing of gas pressure from within the container upon initial opening movement of the moveable tip. Foaming, splashing, or other undesirable discharge of liquid from within the container upon initial opening is desirably abated.

12 Claims, 7 Drawing Sheets

(56) References Cited

U.S. PATENT DOCUMENTS

| | | | | |
|---|---|---|---|---|
| 6,997,359 | B2 * | 2/2006 | Boggs | B65D 47/127 222/520 |
| 7,066,360 | B2 * | 6/2006 | Hearld | B65D 47/243 215/251 |
| 7,644,843 | B1 * | 1/2010 | Bush | B65D 47/0857 215/235 |
| 2001/0040176 | A1 * | 11/2001 | Kimble | B65D 47/0814 222/556 |
| 2002/0074365 | A1 | 6/2002 | Young | |
| 2008/0023502 | A1 | 1/2008 | Knes | |
| 2010/0163509 | A1 * | 7/2010 | Canziani Hoffa | B65D 47/243 215/228 |
| 2015/0197380 | A1 * | 7/2015 | Bashyam | B65D 47/243 222/522 |

FOREIGN PATENT DOCUMENTS

| | | | |
|---|---|---|---|
| WO | 2009106509 | A1 | 9/2009 |
| WO | 2010046566 | A1 | 4/2010 |

* cited by examiner

DISPENSING CLOSURE ASSEMBLY WITH PRE-VENTING

TECHNICAL FIELD

The present invention relates generally to a 'push-pull' type, dispensing closure assembly for a container for a beverage or other liquid, and more particularly to a dispensing closure assembly for a liquid container having internal gas pressure, such as due to carbonation or nitrogen dosing, with the closure assembly configured to provide pre-venting of internal gas pressure upon opening to avoid inadvertent foaming, splashing, or other liquid outflow.

BACKGROUND

Dispensing, push-pull type closure assemblies are known in the art. Push-pull closure assemblies typically include a shell in fluid communication with the interior of a container, and a tip that moves axially with respect to the shell to act as a valve to allow a beverage or other liquid within the container to be dispensed through the assembly.

For some products, such as carbonated beverages, or ones that have been dosed with nitrogen upon filling, internal gas pressure is present within the closure and container package. In the typical push-pull closure arrangement, the configuration of the passage through the closure shell, upon opening, can lead to foaming, splashing, or other undesirable outflow of the beverage or other liquid.

A need therefore exists for a push-pull closure assembly for a container that will allow for pre-venting of the container upon opening to reduce and limit foaming, splashing, or the undesirable outflow of beverage or other liquid.

SUMMARY OF THE INVENTION

In accordance with the present invention, a dispensing closure assembly is provided which is configured to limit and reduce foaming, splashing, or other undesirable discharge of liquid from a container having carbonated or otherwise pressurized contents upon initial opening of the closure assembly. This is achieved by providing the closure assembly with a pre-venting arrangement, preferably in the form of at least one venting projection provided at sealing regions of the closure assembly, in order to effect pre-venting of internal gas pressure from within the closure and container package upon initial opening of the closure assembly.

In accordance an the illustrated embodiment, the present dispensing closure assembly comprises a closure shell having a cylindrical body for fitment onto an associated container, such as by threaded engagement with the container. The closure shell includes a cylindrical mounting collar extending upwardly from the cylindrical body, with the cylindrical body defining at least one central dispensing opening through which product can flow from within the container through the closure shell.

The closure shell further includes a sealing collar positioned inwardly of the mounting collar, and extending upwardly from the cylindrical body of the closure shell around the central dispensing opening.

The closure assembly further includes a moveable tip for controlling flow through the dispensing closure assembly. The moveable tip, which can move axially with respect to the closure shell, includes an outer mounting sleeve for sliding fitment to an outside surface of the mounting collar of the closure shell. The moveable tip further includes an inner sealing plug positioned inwardly of the outer mounting sleeve for sealing engagement with an interior surface of the sealing collar of the closure shell. The moveable tip defines at least one flow opening in communication with a flow region between the outer mounting sleeve and the inner sealing plug.

In an illustrated embodiment, the moveable tip further includes a sealing sleeve positioned outwardly of the sealing plug for sealing engagement with the sealing collar of the closure shell. The moveable tip is moveable between: (1) a first, sealed position in which the sealing plug and the sealing sleeve of the moveable tip engage and seal against the sealing collar of the closure shell to block flow from the container through the closure assembly, and (2) a second, dispensing position wherein the sealing plug and the sealing sleeve of the moveable tip are out of engagement with the sealing collar of the closure shell to permit flow from the container outwardly through the dispensing opening defined by the closure shell, and into the flow region defined by the moveable tip, and out of the flow opening defined by the moveable tip.

In accordance with the present invention, one of the sealing collar and the moveable tip defines at least on venting projection engageable with the other one of the sealing collar and the moveable tip after said movable tip is moved out of said first, sealed position toward said second, dispensing position.

In an illustrated embodiment, the interior surface of the sealing collar of the closure shell defines at least one venting projection engageable with the sealing plug of the moveable tip after the moveable tip is moved out of the first, sealed position toward the second, dispensing position thereof, and after the sealing sleeve of the moveable tip has moved out of sealing engagement with the sealing collar of the closure shell. In the illustrated embodiment, the interior surface of the sealing collar of the closure shell defines a plurality of venting projections positioned in circumferentially spaced apart relationship on the interior surface of the sealing collar.

In accordance with an illustrated embodiment, the sealing plug of the moveable tip has a hollow configuration, with the sealing plug having an axial length greater than an axial length of the sealing sleeve of the moveable tip.

In the preferred form, one of the closure shell and the moveable tip includes a detent projection for cooperation with the other one of the closure shell and moveable tip for releasably retaining the moveable tip in the first, sealed positioned on the closure shell. In the preferred embodiment, the interior surface of the sealing collar defines an outwardly flared, chamfered region for receiving the sealing plug of the moveable tip in sealing engagement with the interior surface of the sealing collar, with the venting projection being positioned on the chamfered region.

Other features and advantages of the present invention would become readily apparent from the following detailed description, the accompanying drawings, and the appended claims.

DETAILED DESCRIPTION

Figure 1:
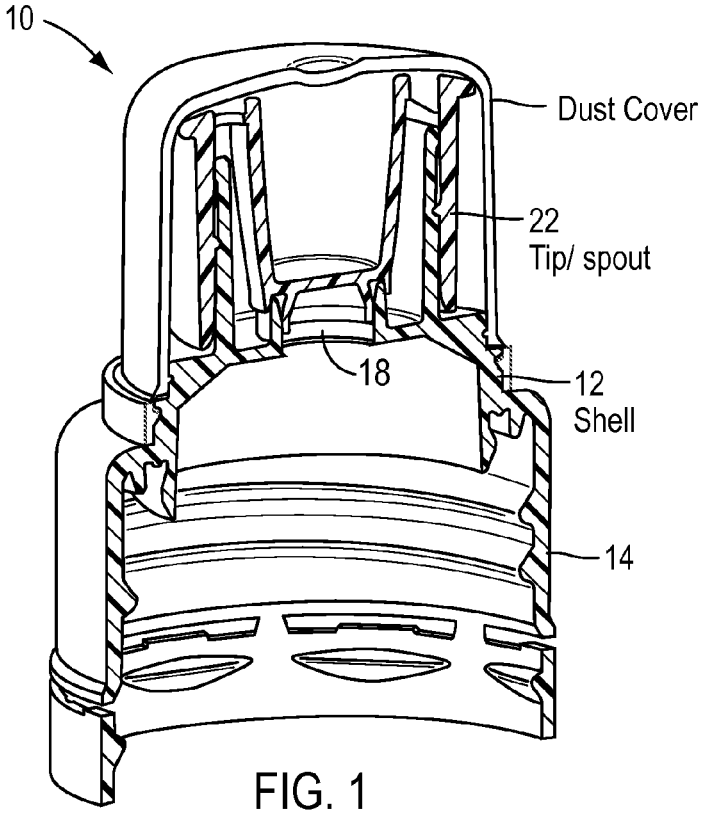
FIG. 1 is a perspective view, shown in cross-section, of a dispensing closure assembly embodying the principles of the present invention.
Figure 2:
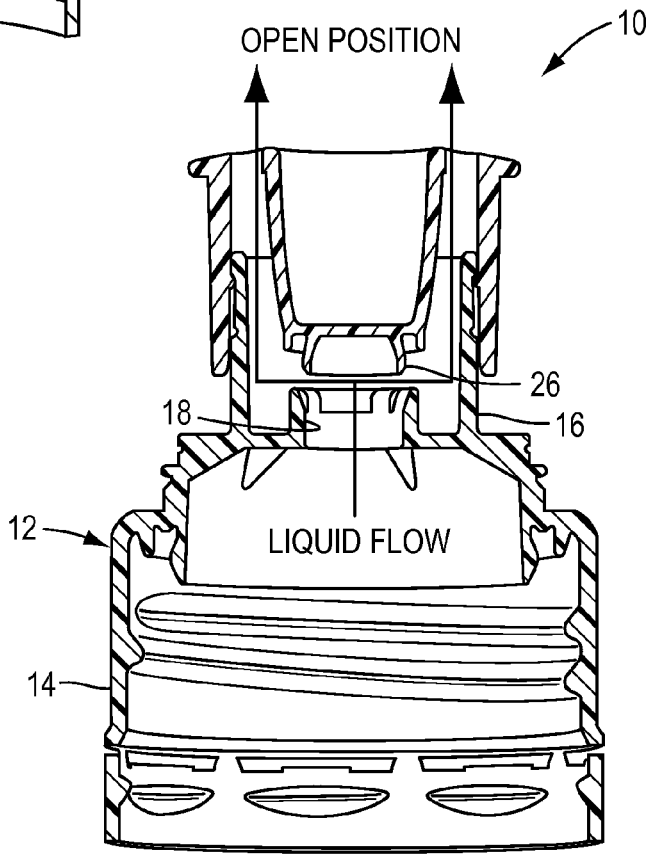
FIG. 2 is a side elevational, cross-sectional view of the closure assembly shown in FIG. 1, illustrated in an open, dispensing position.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

As will be further described, the present invention is directed to a dispensing closure assembly, which is configured to effect pre-venting of an associated container having carbonated or otherwise pressurized contents. By permitting pre-venting of gas pressure from within the associated container upon initial closure opening, foaming, splashing, or other undesirable outflow of liquid from within the container is desirably limited and reduced.

As will be known to those familiar with the art, this type of dispensing closure assembly typically includes three components. The first component is a closure shell which is configured for threaded fitment to the neck portion of an associated container. Typically, the closure shell may include a suitable tamper-evident pilfer band or the like which breaks or otherwise fractures in the event that the closure shell is removed from the associated container.

This type of dispensing closure assembly further includes an axially moveable tip assembled onto the closure shell, with axial movement of the tip providing closed and opened conditions for the closure assembly.

In accordance with the illustrated embodiment, the present closure assembly further includes a dust cover assembled onto the closure shell above the moveable tip. Like the closure shell, the dust cover may include a tamper band that is broken or is otherwise visually discernibly altered attendant to removal of the dust cover from the closure shell. If desired, the dust cover can be permanently removed from the closure assembly upon initial opening.

As will be further described, these components of the present closure assembly are arranged to allow venting of internal gas pressure to start or initiate before the closure assembly is fully opened. This can be particularly desirable for a container having carbonated or otherwise pressurized contents, such as can result from nitrogen liquid dosing of the container during initial filling. As will be further described, the present invention operates to initiate venting of gas pressure from within the container before the closure assembly is fully opened, thereby desirably avoiding foaming or liquid splash from the container as the closure assembly is moved to its fully opened condition.

Notably, the present closure assembly is preferably configured to provide highly effective sealing, thus desirably maintaining the assembly in a sealed condition against internal pressure within the associated container, such as can result from nitrogen dosing and/or carbonation. In previously known dispensing closure arrangements, which did not effect pre-venting in accordance with the present invention, such internal container pressure could undesirably result in liquid being streamed or splashed from the container upon initial closure opening, particularly in the event that a container having carbonated contents was shaken or otherwise agitated.

With reference now to the drawings, therein is illustrated a dispensing closure assembly 10 embodying the principles of the present invention. The closure assembly 10 can be suitably formed from polymeric materials, such as by injection or compression molding. The closure assembly is configured for fitment to an associated container (not shown) with the closure assembly being operable between sealed and opened conditions to permit dispensing of a beverage or other liquid from within the container through the closure assembly.

In accordance with the illustrated embodiment, the closure assembly includes a closure shell 12 having a cylindrical body 14 including an internal thread formation configured for threaded fitment onto an associated container. The closure shell includes a cylindrical mounting collar 16 extending upwardly from the cylindrical body 14, with the body defining at least one central dispensing opening 18 through which liquid can flow from within the associated container through the closure shell.

The closure shell 12 further includes a sealing collar 20, sometimes referred to as a chimney, positioned inwardly of the mounting collar 16, and extending upwardly from the cylindrical body 14 of the closure shell around the dispensing opening 18. The sealing collar 20 provides interior and exterior sealing surfaces for sealing cooperation with the associated moveable component of the dispensing closure assembly.

Selective opening of the closure assembly is provided by an axially moveable tip 22 mounted on mounting collar 16 of the closure shell 12. To this end, the reciprocably moveable tip 22 has an outer mounting sleeve 24 for sliding fitment to an outside surface of the mounting collar 16 of the closure shell. The moveable tip 22 further includes an inner sealing plug 26, preferably having a hollow configuration, which is positioned inwardly of the outer mounting sleeve 24. The inner sealing plug 26 is configured for sealing engagement with an interior surface of the sealing collar 20 of the closure shell.

The moveable tip 22 defines at least one flow opening 28 in fluid communication with a flow region 30 provided between the outer mounting sleeve 24 and the inner sealing plug 26. In order to provide enhanced sealing cooperation between the moveable tip 22 and the closure shell 12, the moveable tip further includes an annular sealing sleeve 32 positioned outwardly of the sealing plug 26 for sealing engagement with an exterior surface of the sealing collar 20 of the closure shell.

In order to provide dispensing of the contents of the associated container, the moveable tip 22 is moveable between: (1) a first, sealed position in which the sealing plug 26 and the sealing sleeve 32 of the moveable tip respectively engage and seal against the interior and exterior surfaces of the sealing collar 20 of the closure shell, to thereby block flow from within the container through the closure assembly; and (2) a second, dispensing position wherein the sealing plug 26 and the sealing sleeve 32 of the moveable tip 22 are out of sealing engagement with the interior and exterior surfaces of the sealing collar 20 of the closure shell, to thereby permit flow from within the container outwardly through the dispensing opening 18 defined by the closure shell, into the flow region 28 defined by the moveable tip, and out of the flow opening 28 defined by the moveable tip.

Figure 3:
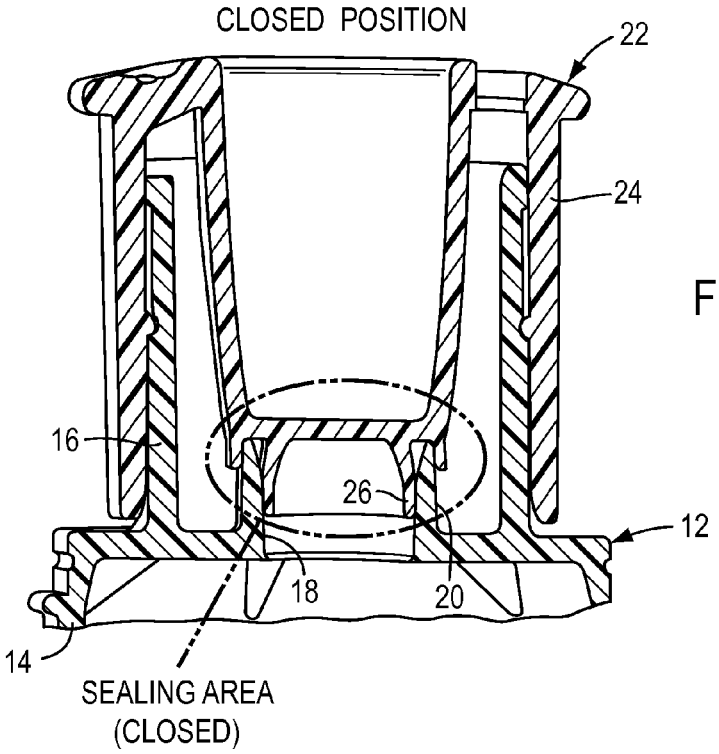
FIG. 3 is a fragmentary, side elevational cross-sectional view of a dispensing closure assembly, showing the sealing region of the assembly.
Figure 4:
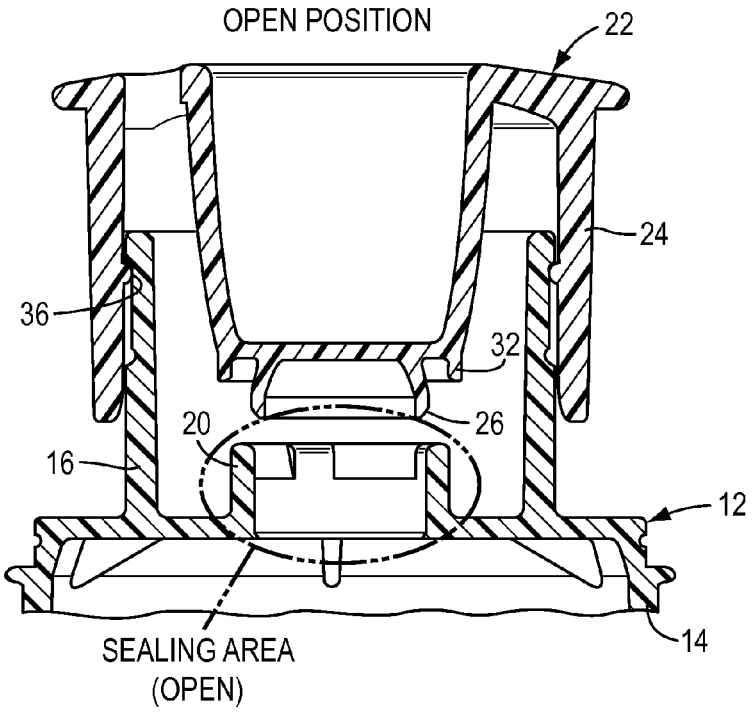
FIG. 4 is a view similar to FIG. 3, illustrating the sealing region of the closure assembly in an open, dispensing position.

The first, sealed and second, dispensing positions of the moveable tip 22 are respectively illustrated in FIGS. 3 and 4. As shown in FIG. 3, the inner sealing plug 26 and sealing sleeve 32 of the moveable tip are in sealing engagement with the sealing collar 20 of the closure shell. In contrast, as shown in FIG. 4, after axial movement of the moveable tip 22 upwardly with respect to the closure shell 12, the sealing plug 26 and the sealing sleeve 32 are moved out of sealing engagement with the sealing collar 20 of the closure shell.

In accordance with the present invention, one of the sealing collar 20 and the moveable tip 22 defines at least one venting projection 34 engageable with the other one of the sealing collar 20 and the moveable tip 22, after the movable tip is moved out of the first, sealed position toward the second, dispensing position.

Figure 5:
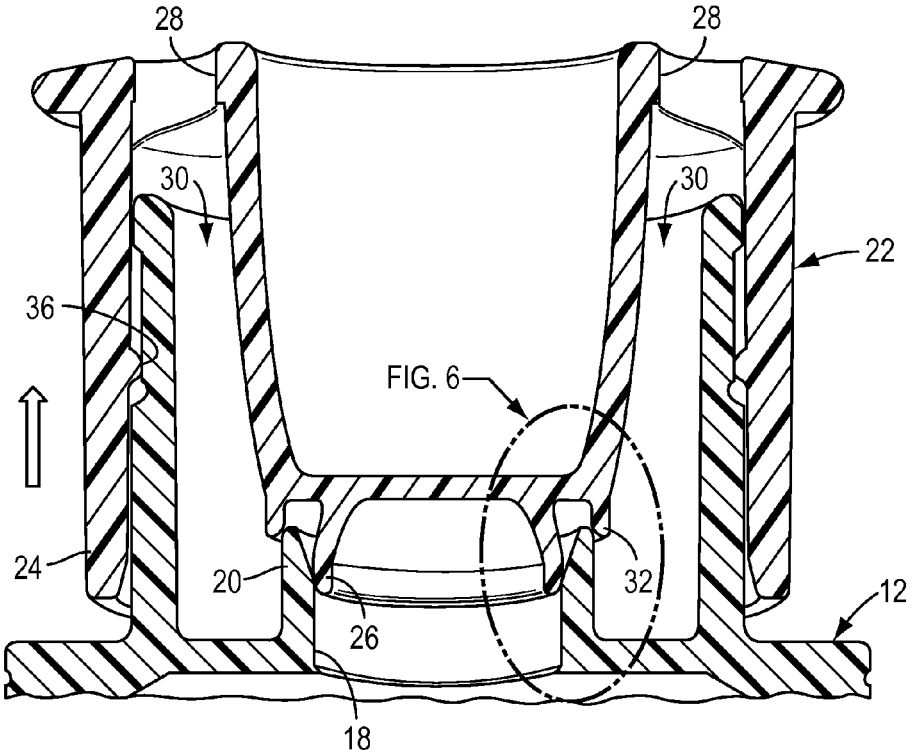
FIG. 5 is a relatively enlarged, cross-sectional view showing partial sealing of the moveable tip of a closure assembly after initial movement of a moveable tip of the assembly from its first, sealed position.
Figure 6:
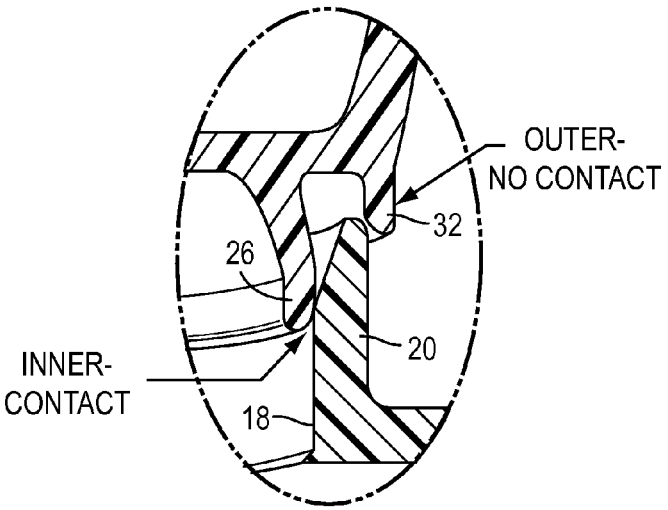
FIG. 6 is a fragmentary view of the sealing region of a closure assembly, as shown in FIG. 5.
Figure 7:
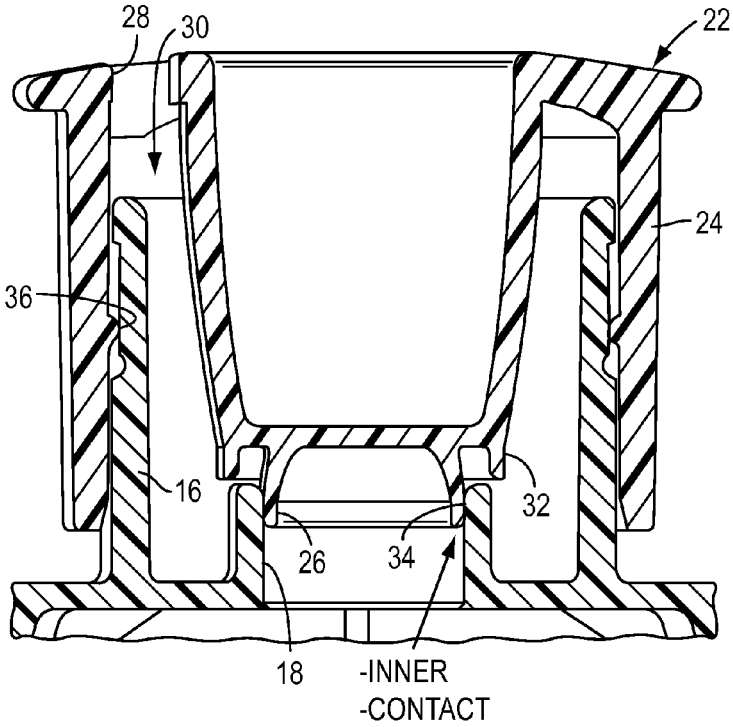
FIG. 7 is a view similar to FIG. 5 of a closure assembly upon further opening movement of the moveable tip of the closure assembly.

In illustrated embodiment, the interior surface of the sealing collar 20 of the closure shell defines at least one venting projection 34 engageable with the sealing plug 26 of the moveable tip, after the moveable tip is initially moved out of its first, sealed position towards its second, dispensing position. By this initial movement of the moveable tip 22, as shown in FIGS. 5, 6, and 7, the sealing sleeve 32 of the moveable tip has moved out of sealing engagement with the sealing collar 20 of the closure shell.

During initial opening movement, sealing engagement between the sealing plug 26 and the interior of sealing collar 20 is maintained, while the outer seal provided by sealing sleeve 32 is lost as the outer seal is moved out of engagement with the exterior surface of sealing collar 20. In this initial opening position of the moveable tip, internal pressure within the associated container is decreased to the pressure level that can be maintained by the inner sealing engagement between the sealing plug 26 and the interior of sealing collar 20.

Figure 8:
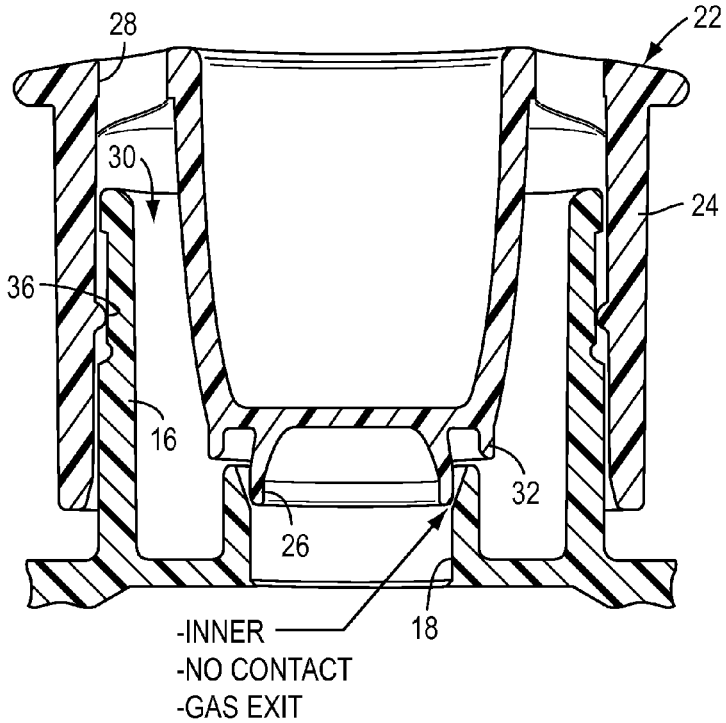
FIG. 8 is a view similar to FIG. 7, showing a closure assembly upon further opening movement of the moveable tip of the closure assembly with respect to the associated closure shell.

As opening movement continues, FIG. 8, the sealing plug 26 only maintains contact with the one or more venting projections 34 provided on the interior surface of sealing collar 20. Gas pressure from within the associated container can vent, while foaming or liquid splash from within the container is desirably avoided.

Figure 11:
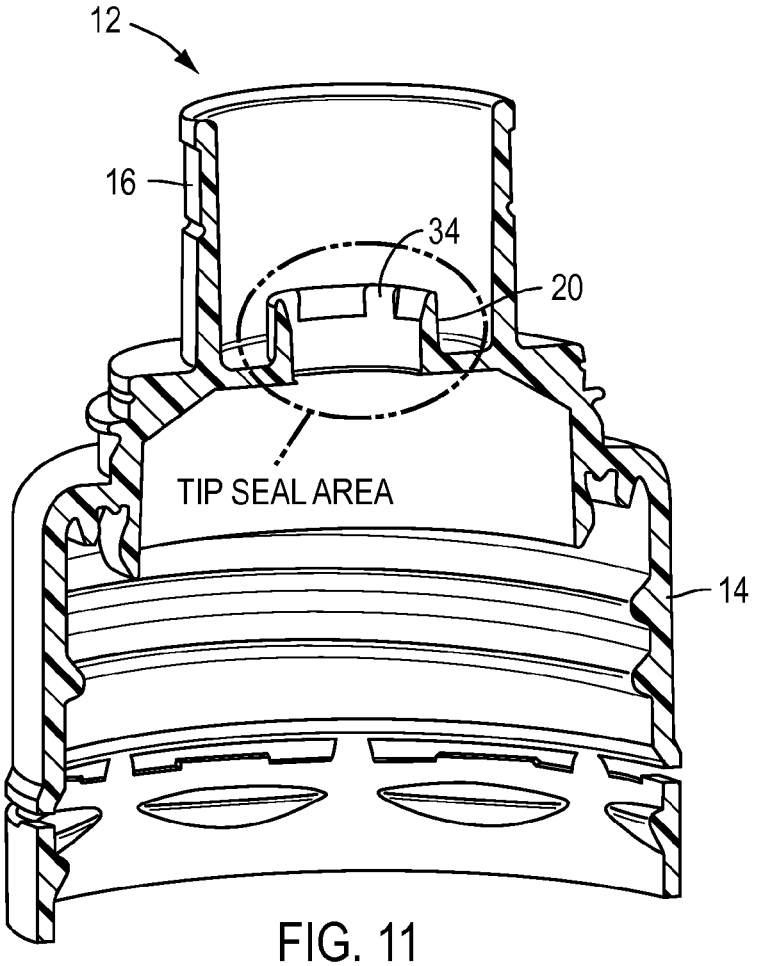
FIG. 11 is a perspective, cross-sectional view of the closure shell of a closure assembly.
Figure 12:
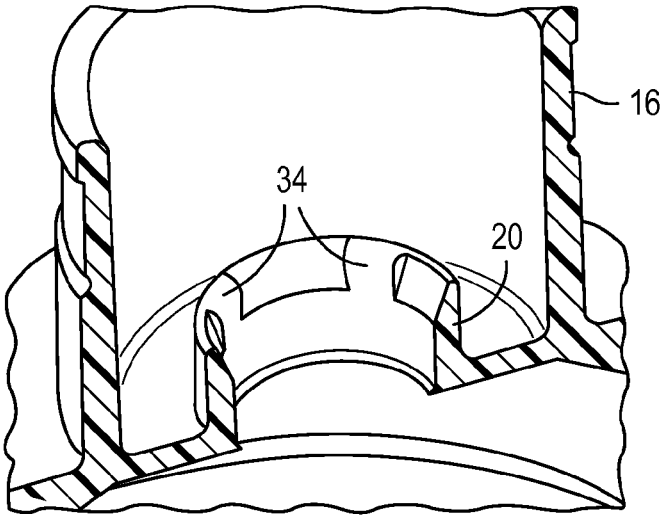
FIG. 12 is a relatively enlarged view of the sealing region of the closure shell shown in FIG. 11.

FIGS. 11 and 12 illustrate a presently preferred configuration of the closure shell, including a plurality of the venting projections 34 provided in circumferentially spaced relationship on the interior surface of sealing collar 20 of the closure shell. As will be appreciated, the circumferentially spaced projections 34 remain in contact with the sealing plug 26 as the moveable tip 22 is initially moved from its first, sealed position, towards its second, dispensing position. This provides the desired pre-venting action for the present closure assembly.

As will be appreciated, preferred structural features of the present dispensing closure assembly provide the desired sequential or staged unsealing of the sealing regions of the assembly. As will be noted, the sealing plug 26 of the moveable tip 22 has an axial length greater than the axial length of the sealing sleeve 32. During opening movement of the moveable tip 22, this configuration of the sealing plug 26 and the sealing sleeve 22 acts to maintain engagement of the sealing plug 26 with sealing collar 20 after sealing sleeve 22 has moved out of sealing engagement with the sealing collar 20. This configuration is presently preferred, but the sealing regions of the closure assembly can be otherwise configured to achieve the desired pre-venting of internal gas pressure.

Sealing cooperation between the sealing plug 26 and the sealing collar 20 of the closure shell is enhanced by the preferred configuration of the sealing collar to include an outwardly flared, chamfered region at its interior surface for receiving the sealing plug 26. As best shown in FIG. 12, the circumferentially spaced venting projections 34 are positioned on the chamfered region of the sealing collar.

In the preferred form, one of the closure shell 12 and the movable tip 22 includes a detent projection 36 for cooperation with the other one of the closure shell 12 and the movable tip 22 for releasably retaining said movable tip in the first, sealed position on said closure shell. To this end, in the illustrated embodiment, the moveable tip 22 includes an annular detent 36, engageable with a suitable annular recessed defined by mounting collar 16, when the moveable tip is in its first, sealed position. The detent thus desirably acts to releaseably maintain the moveable tip in its first position.

Figure 9:
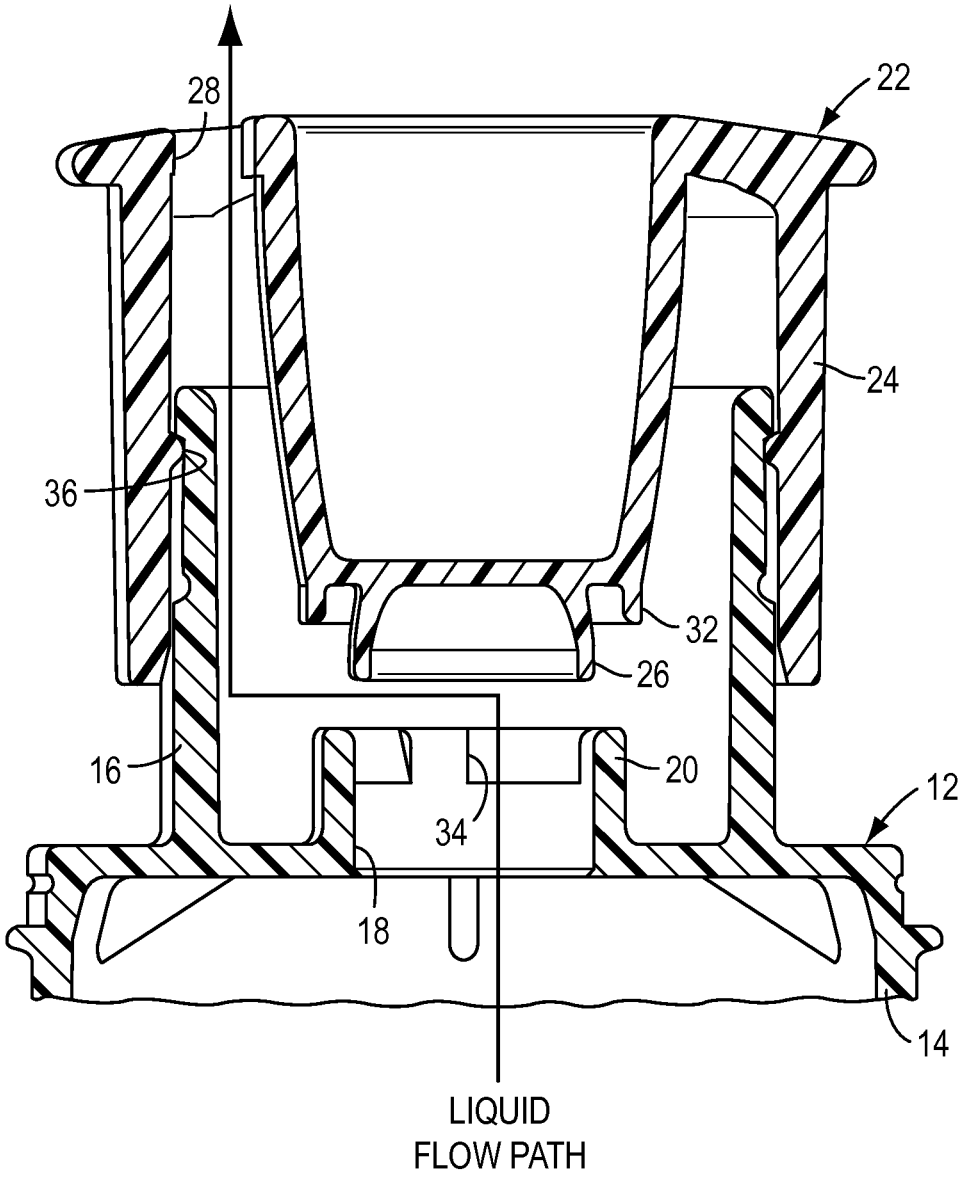
FIG. 9 is a fragmentary, cross-sectional view of a closure assembly, illustrating the moveable tip thereof in a second, dispensing position, illustrating the liquid flow path of the closure assembly.
Figure 10:
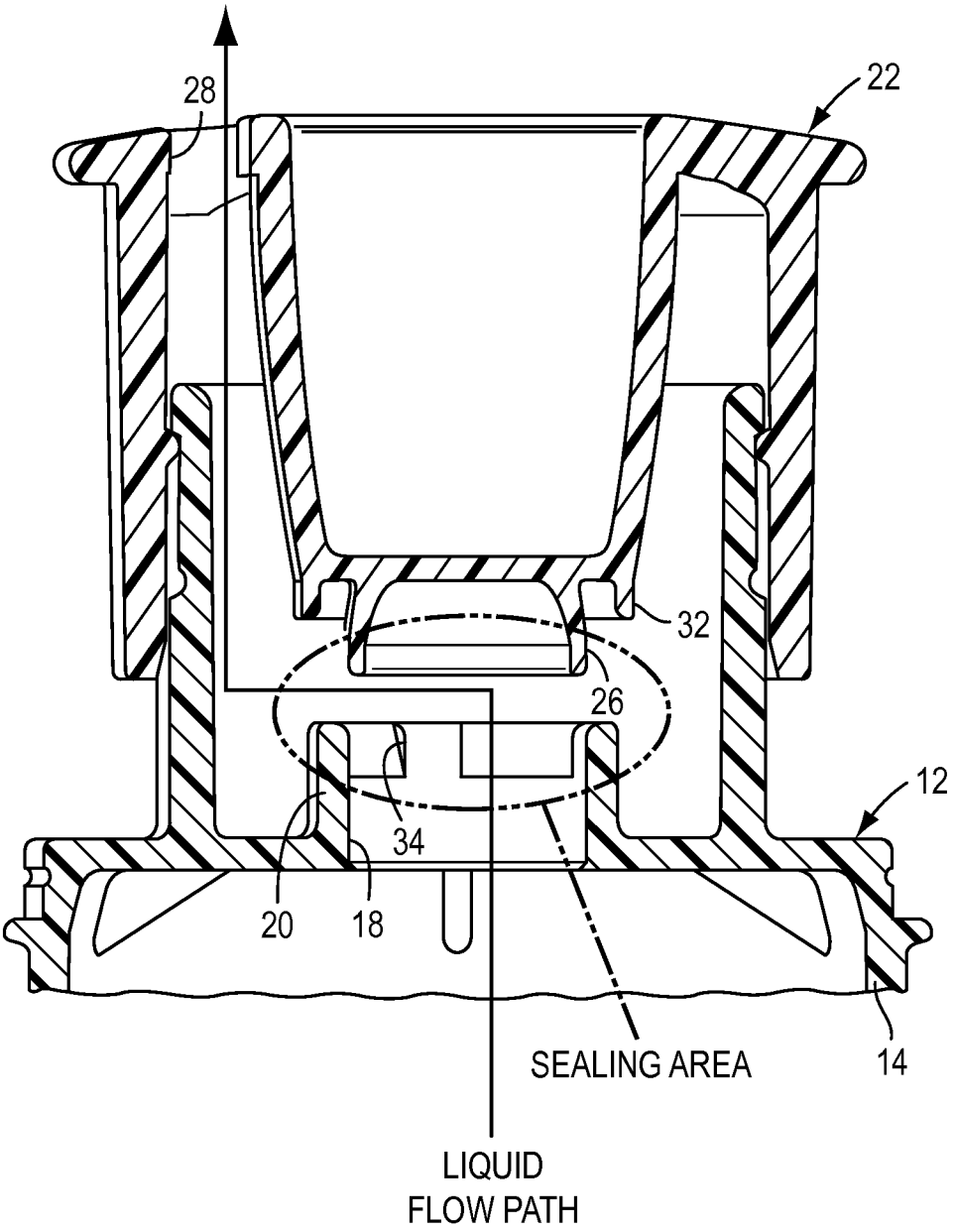
FIG. 10 is a view similar to FIG. 9, further illustrating the sealing region of the closure assembly.

In order to further inhibit undesirable splashing or other discharge of liquid from within the container attendant to initial opening, the flow opening 28 defined by the moveable tip is positioned radially outwardly of the dispensing opening 18 defined by the closure shell. As a consequence, and as best illustrated in FIGS. 9 and 10, the one or more flow openings 28 of the moveable tip are not in the same axis as the sealing region of the closure assembly. As a consequence, liquid product from within the container does not have a direct flow path from the sealing region to the flow openings, and thus needs to change direction during flow (e.g., flow at 90° angles).

As will be appreciated from the foregoing, the present invention provides a versatile arrangement for effecting convenient dispensing of product from a container, while minimizing undesired liquid splashing, foaming, or the like. The flow region 30 between the mounting sleeve 24 and the inner sealing plug 26 can be varied, as may be desired, so that the liquid flowing from the container must fill the flow region before being discharged through flow openings 28.

As noted, in the illustrated embodiment, the sealing region of the closure assembly is defined by the interior and exterior surfaces of the sealing collar 20 on the closure shell 12, and the "double sealing lips" provided on the moveable tip 22 in the form of sealing plug 26 and sealing sleeve 32. Typically, the shell, due to material selection and/or closure geometry, is more rigid than the moveable tip 22, with the illustrated tip geometry thus providing the desired sealing between the components.

Additional features of the present invention enhance dynamic sealing of the assembly. By virtue of the configuration of the sealing plug 26, and the associated sealing collar 20, including venting projections 34, the sealing plug effects sealing and is centered upon closing, with the external sealing, provided by sealing sleeve 32, enhancing sealing at relatively higher pressures. The illustrated arrangement desirably enhances resealing of the closure assembly attendant to opening and closing the moveable tip.

In one aspect, the invention is a dispensing closure assembly (10), comprising: a closure shell (12) having a cylindrical body (14) for fitment onto an associated container, and a cylindrical mounting collar (16) extending upwardly from said cylindrical body (14), said body defining a least one central dispensing opening (18) through which product can flow from said container through said closure shell (12), said closure shell further including a sealing collar (20) positioning inwardly of said mounting collar (16) and extending upwardly from said cylindrical body (14) of said closure shell (12) around said central dispensing opening (18); and a movable tip (22) for controlling flow through said dispensing closure assembly (10), said moveable tip (22) having an outer mounting sleeve (24) for sliding fitment to an outside surface of said mounting collar (16) of said closure shell, and an inner sealing plug (26) positioned inwardly of said outer mounting sleeve (24) for sealing engagement with an interior surface of said sealing collar (20) of said closure shell, said movable tip (22) defining at least one flow opening (28) in communication with a flow region (30) between said outer mounting sleeve (24) and said inner sealing plug (26), said movable tip (22) further including a sealing sleeve (32) positioned outwardly of said sealing plug (26) for sealing engagement with said sealing collar (20) of said closure shell, said movable tip (22) being movable between: (1) a first, sealed position in which said sealing plug (26) and said sealing sleeve (32) of said movable tip (22) engage and seal against sealing collar (20) of said closure shell (12) to block flow from said container through said closure assembly (10), and (2) a second, dispensing position wherein said sealing plug (26) and said sealing sleeve (32) of said movable tip (22) are out of sealing engagement with said sealing collar (20) of said closure shell (12) to permit flow from said container outwardly through said dispensing opening (18) defined by said closure shell (12), into said flow region (28) defined by said movable tip (22), and out of said flow opening (28) defined by said movable tip.

Further aspects include a dispensing closure assembly (10) described above wherein said interior surface of said sealing collar (20) of said closure shell (12) defines at least one venting projection (34) engagable with said sealing plug (26) of said movable tip (22) after said movable tip is moved out of said first, sealed position toward said second, dispensing position, and after said sealing sleeve (32) of said movable tip (22) has moved out of sealing engagement with said sealing collar (20) of said closure shell.

Yet another aspect includes a dispensing closure assembly (10) described above wherein said interior surface of said sealing collar (20) of said closure shell defines a plurality of said venting projections (34) positioned in spaced apart relationship on the interior surface of the sealing collar (20).

Yet another aspect includes a dispensing closure assembly (10) described above wherein said sealing plug (26) of said movable tip (22) has a hollow configuration.

Yet another aspect includes a dispensing closure assembly (10) described above wherein said sealing plug (26) of said movable tip (22) has an axial length greater than an axial length of said sealing sleeve (32) of said movable tip (22).

Yet another aspect includes a dispensing closure assembly (10) described above wherein one of said closure shell (12) and said movable tip (22) includes a detent projection (36) for cooperation with the other of said closure shell (12) and said movable tip (22) for releasably retaining said movable tip (22) in said first, sealed position on said closure shell (12).

Yet another aspect includes a dispensing closure assembly (10) described above wherein said interior surface of said sealing collar (20) defines an outwardly flared, chamfered region for receiving said sealing plug (26) of said movable tip (22) in sealing engagement with the interior surface of the sealing collar (20), said venting projection (34) being positioned on said chamfered region.

Another aspect of the present invention is a dispensing closure assembly (10), comprising: a closure shell (12) having a cylindrical body (14) for fitment onto an associated container, and a cylindrical mounting collar (16) extending upwardly from said cylindrical body (14), said body defining a least one central dispensing opening (18) through which product can flow from said container through said closure shell (12), said closure shell further including a sealing collar (20) positioning inwardly of said mounting collar (16) and extending upwardly from said cylindrical body (14) of said closure shell (12) around said central dispensing opening (18); and a movable tip (22) for controlling flow through said dispensing closure assembly (10), said moveable tip (22) having an outer mounting sleeve (24) for sliding fitment to an outside surface of said mounting collar (16) of said closure shell, and an inner sealing plug (26) positioned inwardly of said outer mounting sleeve (24) for sealing engagement with an interior surface of said sealing collar (20) of said closure shell, said movable tip (22) defining at least one flow opening (28) in communication with a flow region (30) between said outer mounting sleeve (24) and said inner sealing plug (26), said movable tip (22) being movable between: (1) a first, sealed position in which said sealing plug (26) and said sealing sleeve (32) of said movable tip (22) engage and seal against sealing collar (20) of said closure shell (12) to block flow from said container through said closure assembly (10), and (2) a second, dispensing position wherein said sealing plug (26) and said sealing sleeve (32) of said movable tip (22) are out of sealing engagement with said sealing collar (20) of said closure shell (12) to permit flow from said container outwardly through said dispensing opening (18) defined by said closure shell (12), into said flow region (28) defined by said movable tip (22), and out of said flow opening (28) defined by said movable tip, wherein said interior surface of said sealing collar (20) of said closure shell (12) defines at least one venting projection (34) engagable with said sealing plug (26) of said movable tip (22) after said movable tip is moved out of said first, sealed position toward said second, dispensing position, and after said sealing sleeve (32) of said movable tip (22) has moved out of sealing engagement with said sealing collar (20) of said closure shell.

Yet another aspect includes a dispensing closure assembly (10) described above wherein said interior surface of said sealing collar (20) of said closure shell (12) defines a plurality of said venting projections (34) positioned in spaced apart relationship on the interior surface of the sealing collar (20).

Yet another aspect includes a dispensing closure assembly (10) described above wherein said interior surface of said sealing collar (20) defines an outwardly flared, chamfered region for receiving said sealing plug (26) of said movable tip (22) in sealing engagement with the interior surface of the sealing collar (20), said venting projection (34) being positioned on said chamfered region.

Yet another aspect includes a dispensing closure assembly described above wherein said flow opening (28) defined by said movable tip (22) is positioned radially outwardly of said dispensing opening (18) defined by said closure shell.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A dispensing closure assembly (10), comprising:

a closure shell (12) having a cylindrical body (14) for fitment onto an associated container, and a cylindrical mounting collar (16) extending upwardly from said cylindrical body (14), said cylindrical body defining at least one central dispensing opening (18) through which product can flow from said container through said closure shell (12), said closure shell further including a sealing collar (20) positioned inwardly of said cylindrical mounting collar (16) and extending upwardly from said cylindrical body (14) of said closure shell (12) around said central dispensing opening (18); and a movable tip (22) for controlling flow through said dispensing closure assembly (10), said moveable tip (22) having an outer mounting sleeve (24) for sliding fitment to an outside surface of said cylindrical mounting collar (16) of said closure shell, and an inner sealing plug (26) positioned inwardly of said outer mounting sleeve (24) for sealing engagement with an interior surface of said sealing collar (20) of said closure shell, said movable tip (22) defining at least one flow opening (28) in communication with a flow region (30) between said outer mounting sleeve (24) and said inner sealing plug (26), said movable tip (22) further including a sealing sleeve (32) positioned outwardly of said sealing plug (26) for sealing engagement with said sealing collar (20) of said closure shell, said movable tip (22) being movable between: (1) a first, sealed position in which said sealing plug (26) and said sealing sleeve (32) of said movable tip (22) engage and seal against sealing collar (20) of said closure shell (12) to block flow from said container through said closure assembly (10), and (2) a second, dispensing position wherein said sealing plug (26) and said sealing sleeve (32) of said movable tip (22) are out of sealing engagement with said sealing collar (20) of said closure shell (12) to permit flow from said container outwardly through said dispensing opening (18) defined by said closure shell (12), into said flow region (28) defined by said movable tip (22), and out of said flow opening (28) defined by said movable tip.

2. A dispensing closure assembly (10) in accordance with claim 1, wherein one of said sealing collar (20) and said moveable tip (22) defines at least one venting projection engageable with the other one of the sealing collar (20) and the moveable tip (22) after said movable tip is moved out of said first, sealed position toward said second, dispensing position.

3. A dispensing closure assembly (10) in accordance with claim 2, wherein said interior surface of said sealing collar (20) of said closure shell defines a plurality of said venting projections (34) positioned in spaced apart relationship on the interior surface of the sealing collar (20).

4. A dispensing closure assembly (10) in accordance with claim 2, wherein said interior surface of said sealing collar (20) defines an outwardly flared, chamfered region for receiving said sealing plug (26) of said movable tip (22) in sealing engagement with the interior surface of the sealing collar (20), said venting projection (34) being positioned on said chamfered region.

5. A dispensing closure assembly in accordance with claim 4, wherein said flow opening (28) defined by said movable tip (22) is positioned radially outwardly of said dispensing opening (18) defined by said closure shell.

6. A dispensing closure assembly (10) in accordance with claim 1, wherein said interior surface of said sealing collar (20) of said closure shell (12) defines at least one venting projection (34) engagable with said sealing plug (26) of said movable tip (22) after said movable tip is moved out of said first, sealed position toward said second, dispensing position, and after said sealing sleeve (32) of said movable tip (22) has moved out of sealing engagement with said sealing collar (20) of said closure shell.

7. A dispensing closure assembly (10) in accordance with claim 1, wherein said sealing plug (26) of said movable tip (22) has a hollow configuration.

8. A dispensing closure assembly (10) in accordance with claim 1, wherein said sealing plug (26) of said movable tip (22) has an axial length greater than an axial length of said sealing sleeve (32) of said movable tip (22).

9. A dispensing closure assembly (10) in accordance with claim 1, wherein one of said closure shell (12) and said movable tip (22) includes a detent projection (36) for cooperation with the other of said closure shell (12) and said movable tip (22) for releasably retaining said movable tip (22) in said first, sealed position on said closure shell (12).

10. A dispensing closure assembly (10), comprising:

a closure shell (12) having a cylindrical body (14) for fitment onto an associated container, and a cylindrical mounting collar (16) extending upwardly from said cylindrical cylindrical body (14), said body defining at least one central dispensing opening (18) through which product can flow from said container through said closure shell (12), said closure shell further including a sealing collar (20) positioning inwardly of said cylindrical mounting collar (16) and extending upwardly from said cylindrical body (14) of said closure shell (12) around said central dispensing opening (18); and a movable tip (22) for controlling flow through said dispensing closure assembly (10), said moveable tip (22) having an outer mounting sleeve (24) for sliding fitment to an outside surface of said cylindrical mounting collar (16) of said closure shell, and an inner sealing plug (26) positioned inwardly of said outer mounting sleeve (24) for sealing engagement with an interior surface of said sealing collar (20) of said closure shell, said movable tip (22) defining at least one flow opening (28) in communication with a flow region (30) between said outer mounting sleeve (24) and said inner sealing plug (26), said movable tip (22) being movable between: (1) a first, sealed position in which said sealing plug (26) and a sealing sleeve (32) of said movable tip (22) engage and seal against sealing collar (20) of said closure shell (12) to block flow from said container through said closure assembly (10), and (2) a second, dispensing position wherein said sealing plug (26) and said sealing sleeve (32) of said movable tip (22) are out of sealing engagement with said sealing collar (20) of said closure shell (12) to permit flow from said container outwardly through said dispensing opening (18) defined by said closure shell (12), into said flow region (28) defined by said movable tip (22), and out of said flow opening (28) defined by said movable tip, wherein said interior surface of said sealing collar (20) of said closure shell (12) defines at least one venting projection (34) engagable with said sealing plug (26) of said movable tip (22) after said movable tip is moved out of said first, sealed position toward said second, dispensing position, and after said sealing sleeve (32) of said movable tip (22) has moved out of sealing engagement with said sealing collar (20) of said closure shell.

11. A dispensing closure assembly (10) in accordance with claim 10, wherein said interior surface of said sealing collar (20) of said closure shell (12) defines a plurality of said venting projections (34) positioned in spaced apart relationship on the interior surface of the sealing collar (20).

12. A dispensing closure assembly (10) in accordance with claim 10, wherein said interior surface of said sealing collar (20) defines an outwardly flared, chamfered region for receiving said sealing plug (26) of said movable tip (22) in sealing engagement with the interior surface of the sealing collar (20), said venting projection (34) being positioned on said chamfered region.

* * * * *